US006685030B1

(12) United States Patent
Mileaf

(10) Patent No.: US 6,685,030 B1
(45) Date of Patent: Feb. 3, 2004

(54) EXPANDED FLATS BUNDLE COLLATOR

(75) Inventor: Daryl S. Mileaf, Hanover, MD (US)

(73) Assignee: Northrop Grumman Corporation, Los Angeles, CA (US)

( * ) Notice: Subject to any disclaimer, the term of this patent is extended or adjusted under 35 U.S.C. 154(b) by 146 days.

(21) Appl. No.: 09/871,620

(22) Filed: Jun. 4, 2001

Related U.S. Application Data

(63) Continuation-in-part of application No. 09/310,221, filed on May 12, 1999, now Pat. No. 6,241,099.

(51) Int. Cl.[7] ..... B07C 5/02

(52) U.S. Cl. ..... 209/542; 209/584; 209/900; 209/918

(58) Field of Search ..... 209/542, 584, 209/900, 918, 919, 964, 541, 545

(56) References Cited

U.S. PATENT DOCUMENTS 4,503,977 A 3/1985 Kohno et al.
4,627,540 A 12/1986 Takeda
5,119,954 A 6/1992 Svyatsky et al.
6,241,099 B1 * 6/2001 Hendrickson et al. ..... 209/542
6,328,302 B2 * 12/2001 Hendrickson et al. ..... 271/207
6,443,311 B2 * 9/2002 Hendrickson et al. ..... 209/542

FOREIGN PATENT DOCUMENTS

JP 4200677 7/1992
SU 1623798 1/1991

* cited by examiner

*Primary Examiner*—Donald P. Walsh
*Assistant Examiner*—Jonathan R. Miller
(74) *Attorney, Agent, or Firm*—Birch, Stewart, Kolasch & Birch, LLP.

(57) ABSTRACT

A method and system for collating groups of flats mail items for a plurality of carrier routes into carrier walk order sequence (CWS) using a Flats Bundle Collator (FBC) system which is capable of pre-staging carrier route subsets in one or more staging towers, or immediately collating a group into CWS for a group being fed into the system. The pre-staged subsets can be collated by the staging towers on demand. A U-shaped footprint for the FBC facilitates loading and unloading by the same operator. Additional input feeders may be added to the modular FBC, as well as random sequence towers.

35 Claims, 8 Drawing Sheets

(4 of 8 Drawing Sheet(s) Filed in Color)

EXPANDED FLATS BUNDLE COLLATOR

RELATED APPLICATION

This application is a continuation-in-part of prior application, referred to hereinafter as the parent application, Ser. No. 09/310,221, filed May 12, 1999, now U.S. Pat. No. 6,241,099, the details of which are incorporated herein by reference and which is assigned to the same assignee as the present invention.

BACKGROUND OF THE INVENTION

1. Field of the Invention

The present invention relates to a method and system for collating a plurality of flats mail items for a plurality of carrier routes into carrier walk order sequence (CWS) for each respective route.

More specifically, the present invention relates to a method and system for collating flats mail for multiple carrier routes using expanded capabilities of the Flats Bundle Collator (FBC) described and claimed in the aforementioned parent application Ser. No. 09/310,221, now U.S. Pat. No. 6,241,099.

2. Description of Related Art

The United States Post Service (USPS) allows the mailing industry to prepare mail in a number of formats and sequences. Levels of savings incentives are provided to mailers to format the mail as closely as possible to the actual sequence that the mail is delivered. In doing so, the USPS creates internal savings by reducing the amount of processing and handling required to distribute and deliver the mail and passes a portion of this savings back to their customers through the incentives. For example, a mailing prepared to "carrier route" is prepared by separately packaging the product in bundles. Each bundle goes to a specific carrier at a specific post office. The USPS can then process this mail by shipping it directly to the specific post office delivery unit (DU) rather than shipping it through a number of distribution facilities and processing it within those facilities. At the specific (destination) post office, the clerks can simply distribute each bundle to the appropriate carrier, rather than having to break down bundles and sort the mail within the bundle to the carriers. At each step in the distribution process, savings are realized by reducing the amount of processing required.

As carriers receive their mail for the day, they sort the mail in into what is referred to as "Carrier Walk Sequence". They do so by "casing" the mail. This operation is the process of placing each piece of mail into a cubbyhole in a matrix of cubbyholes. This is done in such a manner that by placing and then removing the mail from the cubbyholes the carrier creates a bundle of mail that is in exactly the sequence that they will deliver it. All mail for each address in the route is together. As the carrier walks or drives their route, they simply remove mail from the top of the bundle at each stop. Various metrics are used to determine the rate at which mail can be cased. Mail presented to the carrier in walk sequence can be cased much faster than purely random mail. Typically a carrier cases random mail at 8 pieces per minute and sequenced mail at 18 pieces per minute. In order to facilitate more productive casing operations, the USPS will pass a portion of the savings created by sequenced mail back to the mailers in incentives (i.e. mailers are charged less per piece to mail a sequenced mailing than to mail a random mailing).

Recently, the USPS has identified the need for a Flats Bundle Collator (FBC), such as the system disclosed in the aforementioned parent application Ser. No. 09/310,221, now U.S. Pat. No. 6,241,099. This system takes multiple flats (periodicals and similarly sized mail) mailings for a single carrier route and automatically collates them together into a single bundle, similar to the output of the carrier casing operation. In order to perform this operation, it was thought that each individual mailing would preferably be in carrier walk sequence and the system would then simply collate the sequenced mailings together. While this constraint is true for most collating systems, this application describes a process that would eliminate this constraint for the Flats Bundle Collator by intelligently applying the inherent characteristics of the system design, by expanding the system to process mail items from multiple carrier routes during overlapping time periods.

In general, Delivery Unit (DU) operations are consistent from one post office to another; however, different route types (rural, city, park and loop) may process flats in slightly different manners within the same facility. At present, the flats to be processed arrive from a variety of sources in a number of different ways, namely:

(a) Mailers may drop ship saturation mailings 2 to 7 days prior to the delivery per an agreement with the local postmaster.

(b) Other mailings can arrive on pallets (5-digit periodicals, national advertisements or catalogs), after passing through the postal network of facilities, as cross-dock material.

(c) Other material may be broken down from pallets at an upstream facility if a pallet was shipped as 3-digit material.

(d) Other flats may have been processed on flats sorting equipment, and arrive processed to carrier route.

(e) Still more material can pass through Bulk Mail Centers as bundles before arriving at the DU.

With the exception of saturation mailings, the majority of this material is not currently in carrier walk sequence (cws). Bundles may be in Enhanced Carrier Line-of-Travel (ECLOT) or in carrier route but not walk sequence. Preferably, bundles will have an 11-digit (ZIP+4+2) delivery point bar code. Many saturation mailings will have no bar code and may be addressed to "Postal Customer" with no address. Other mailings may have 5 or 9 digit ZIP Codes and "marriage" mailings consisting of two materials: an address card or leaflet and a second mailing with no address label intended to be left at the same address as the card. While some of this material does not meet the current specification for processing on a Flats Bundle Collator, such as that of the aforementioned parent application, the vast majority, if not all, of this material will be modified in the future for processing on this type of machine. Or, the machinery can be modified to accommodate this wider mail base (i.e. addition of OCR) if the cost/benefits analysis indicates that it is fiscally beneficial to do so.

SUMMARY OF THE INVENTION

Accordingly, it is a primary object of the present invention to expand the use and capabilities of the FBC system of the aforementioned parent application Ser. No. 09/310,221, now U.S. Pat. No. 6,241,099, by using some of the storage towers thereof as pre-staging areas for multi-carrier routes, in addition to the tower's primary capabilities for collation of single carrier routes.

It is another object of the present invention to alter the footprint configuration of the FBC to facilitate loading and unloading by a single operator at a single station.

It is a further object of the present invention to expand the FBC to process random mailings, and additional feeders.

The objects of the invention are fulfilled by providing a method of collating a plurality of mail items into a final sequenced set of the items for delivery to predetermined delivery points of a plurality of carrier routes, comprising the steps of:

a) feeding the mail items from a single input stream to a staging station;

b) sampling each mail item in the input stream to determine a carrier route identity, and a delivery point thereof;

c) pre-staging selected ones of the mail items at the staging station into a plurality of subsets of mail items, said staging station having a plurality of storage units $X_1$ to $X_n$, wherein n is the total number of storage units, said storage units temporarily storing said items in said carrier-specific subsets by inserting each mail item into a carrier-specific subset in a selected one of the storage units;

d) selectively sorting the mail items of either pre-staged carrier-specific subsets or mail items of a carrier route being fed from the single input stream at the staging station into one or more of subsets of mail items re-sequenced into an intermediate order, as an intermediate step to achieving said final sequenced set, said storage units temporarily storing said items in said subsets by;

1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items; and 2) selectively extracting the mail items from any selected one of the storage units $X_1$ to $X_n$ according to said extraction plan; and e) merging the extracted mail items into a single output stream from the respective subsets of mail items into said final sequenced set in delivery point sequence (DPS).

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The patent or application file contains at least one drawing executed in color. Copies of this patent or patent application publication with color drawings will be provided by the U.S. Patent and Trademark Office upon request and payment of the necesssary fee.

DETAILED DESCRIPTION OF PREFERRED EMBODIMENTS

Figure 1:
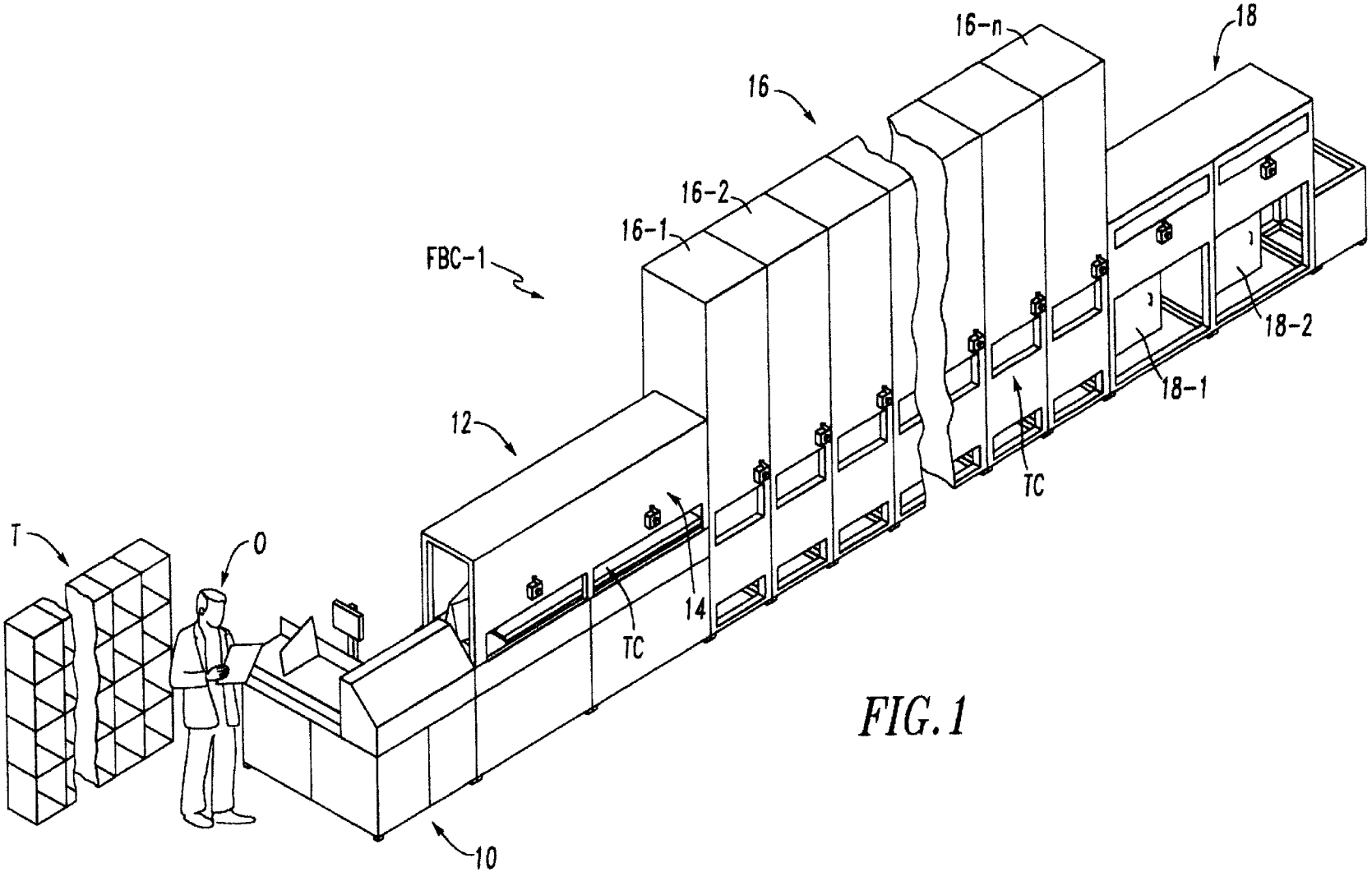
FIG. 1 depicts the Flats Bundle Collator (FBC) system of the aforementioned application Ser. No. 09/310,221, now U.S. Pat. No. 6,241,099.

FIG. 1 depicts the Flats Bundle Collator (FBC) system of the aforementioned application Ser. No. 09/310,221, filed May 12, 1999, now U.S. Pat. No. 6,241,099, the full disclosure thereof which is incorporated herein by reference.

The FBC system of FIG. 1 eliminates the need for manual carrier casing of flats mail, carrier-casing operations being manually intensive and expensive. There are approximately 300,000 routes in the United States and each route is manually cased in the morning. Typically, this activity takes an average of 3 hours to perform before the carrier has all the mail prepared for delivery. Approximately 10 years ago, the USPS developed sorting technology for letter mail to provide carriers with letters already in walk sequence. This technology accomplished this by performing multiple sorting passes (i.e. processing the same mail on a machine two or three times). This technology eliminated the need for carriers to case most of their letter mail and produced cost savings. Recently, the USPS has sought to develop, or purchase technology to perform the same function on flats mail. Most cased mail is flats mail. The system is based on a set of USPS assumptions and requirements, the most important of which is that mailers will be given incentives to provide flats mail in mailings that are in carrier walk sequence. Based on that assumption, a system has been developed to process this mail in a single pass of collating rather than multiple passes or sorting. Such a system is described in the above referenced parent application Ser. No. 09/310,221 and generally illustrated in FIG. 1.

One approach to the proposition of collating multiple bundles of flats mail that is already in sequence is to use a multiple feeder system design. Each feeder has one mailing loaded into it and the system simply reads the next piece off of each feeder and determines how to merge the pieces together. The resulting bundle of mail at the system output is in sequence (i.e. Time for stop 22 gets put between the Newsweek for stops 20 and 23 etc.).

The FBC design of FIG. 1 is a single feeder system that uses a number of staging towers to store mail in process. The system uses a two-phase processing approach. Mail is initially fed into the system and then fed out during the collation stage. As mail is fed into the system, the towers are populated in the walk sequence. The system maintains an inventory of the location of each stored mail piece. During the collation process, the mail is fed back onto the system conveyor such that the output is a single bundle of mail in walk sequence.

Mail pieces are merged together after they have been singulated (separated in to single mail pieces), read (using a bar code reader and/or an optical character reader) and staged. This allows for processing alternatives beyond collating such as sequencing and sequencing repair (i.e. processing out of sequence pieces back into sequence using multiple manipulations within the tower staging system).

The system shown in FIG. 1 includes the following components: a feeder assembly 10; a combined orienter/reader assembly including a transport conveyor TC and a flats orienter module 12; a barcode reader module 14; a staging tower assembly 16 including multiple staging towers 16-1, 16-2 . . . , 16-n; and a containerizer module 18 including two containerizer assemblies 18-1 and 18-2. Bundles of mail in the United States Postal System (USPS) mail tubs T are loaded onto the feeder assembly 10 by an operator O. The mail is first oriented to have the mailing label up by the orienter module 12. The address is then read by the barcode reader module 14. All of the mailings F, except for the last, are staged in the staging tower assembly 16. Mail is removed from the multiple staging towers as the last mailing is fed from the feeder 10 in such a way as to make the mail stream in a desired final sequence. The mail is conveyed out of the staging tower assembly 16 to the containerizer module 18, where it is stacked in selected ones of USPS tubs, not shown. Multiple pre-sequenced mailings can be fed into the machine. Each mailing can consist of several bundles of mail, each bundle containing several pieces. Each mailing is in delivery point sequence (DPS) or carrier walk sequence (CWS).

The operator O places all but the last mailing in the feeder 10 with the lower number stop in the first position. The feeder 10 then removes one piece of flats mail F at a time from the stack and injects it into the flats orienter module 12. The feeder 10 will feed all of the mail in this manner until it reaches the last mailing. The last mailing is loaded with the lowest number stop in the last position.

If a saturation mailing (a mass mailing) is not to be included in the sorting process, the operator notifies the system that loading is complete by pressing a button on the system control panel to be described hereinafter. However, if there is a saturation mailing, the operator notifies the system and begins loading the saturation mailing into the feeder 10. The system compares the contents of the staging tower assembly 16 to the carrier's walk sequence and calculates the output sequence to collate the system contents into the sequence. If there is not a saturation mailing, the system calculates the output sequence directly from the tower contents. If a saturation mailing is included, the system calculates the output sequence from the towers 16-1, . . . , 16-n and includes the feeder 10 saturation output in the collation calculation.

The tower assembly 16 outputs the flats F, and the feeder 10 inputs saturation flats, if they are present, such that they are transported into the mail tubs in the containerizer module 18. The operator O then removes the tubs and prepares to input the next carrier route bundles into the system.

The FBC system shown in FIG. 1 is designed to support the present USPS Flat Bundle Collator Statement of Work requirements to collate a single carrier's daily volume of presequenced flat mail bundles. The inherent flexibility of the design approach allows for system configurations capable of performing the following additional functions in accordance with the present invention:

(1) System expansion to process more mailings;

(2) Addition of random access towers to provide limited sequencing;

(3) System and/or tower expansion to provide multi-carrier staging and collation;

(4) System layout changes to accommodate available floor-space and enhance operator utilization;

(5) Multiple feeder configurations to pre-collate large mailings (saturation and mixed DPS) and then collate that mail stream with the contents of the staging towers;

(6) System configuration changes to provide complete sequencing capability;

(7) Optical Character Recognition (OCR) capability; and (8) Use of data file input or sort plan editing to process mailings without unique addressing including;

(a) Saturation mailings (100% residential or route mailings do not require data files), and (b) Marriage mailings (data file created from address card or process simultaneously from two feeders, or process from data file thus eliminating the need for the address card).

Each of these capabilities can be implemented individually or in any combination.

Figure 2:
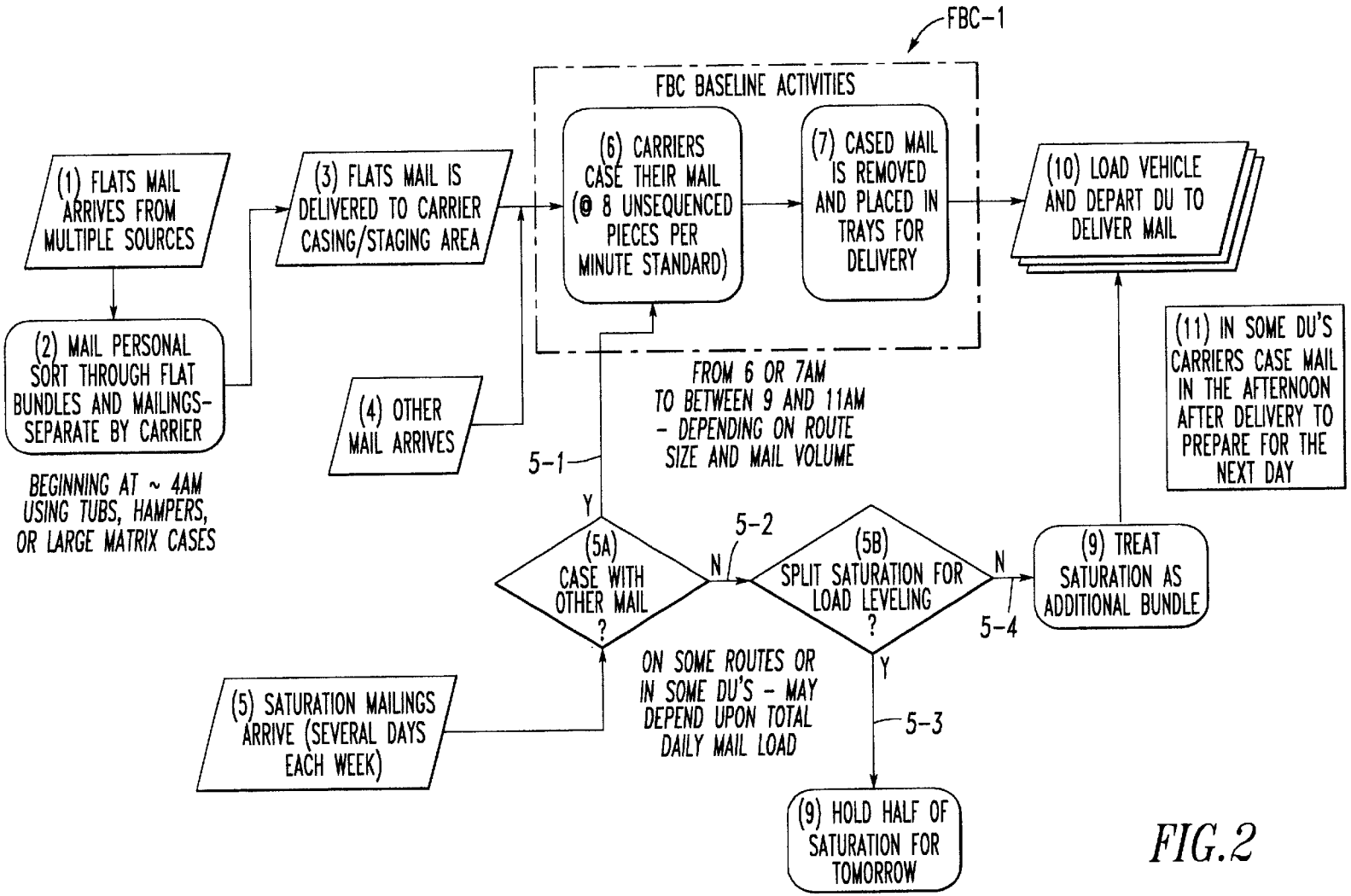
FIG. 2 is a flowchart showing the current procedure For processing mail at a USPS Delivery Unit (DU), and use of the FBC system of FIG. 1 to collate bundles of mail for a single carrier route at a time.

FIG. 2 is a flowchart illustrating "activity blocks" (1) to (11), which presently take place in U.S. Postal distribution units (DU) utilizing the FBC 16-1 of FIG. 1 to simply collate mailings of one carrier at a time. As illustrated in this flowchart in block (1), flats mail arrives from multiple sources to the distribution units (DU) at various times of the day. As illustrated in block (2), beginning at about 4:00 a.m. using tubs, hampers, or large matrix cases, mail personnel sort through the flat bundles and mailings and separate them by carrier. This is primarily done by hand or by automated equipment with limitations on its efficiencies. Once separated by carrier as indicated in block (3), flats mail is then delivered to the carrier casing/staging areas of the FBC collator system FBC-1. This collation process is enclosed within a block that includes activity blocks (6) and (7) of the process performed by the FBC-1 depicted in the system of FIG. 1 according to the procedure described in the aforementioned parent application Ser. No. 09/310,221, now U.S. Pat. No. 6,241,099.

That is, in block (6), carriers case their regular mail at about eight (8) unsequenced pieces per minute standard, and flats mail is collated by the FBC-1, as indicated in block (10) into mail tubs by the containerizer 18 of FIG. 1.

Most of the activities in blocks (6) and (7) are performed between 6:00 and 7:00 a.m., or between 9:00 and 11:00 a.m. depending on the route size of the carrier and the mail volume. Meanwhile, other types of mail arrive at the distribution unit, as indicated in block (4), and saturation mailings, as indicated in block (5) arrive several days each week. These "other mail" activities and saturation mailings are merged into the collated mail items for the respective carrier routes. Regarding the saturation mailings, they may be cased with other mail being collated at the end of the collation process for a respective carrier, as indicated in block (5A) and path 5-1 of FIG. 2, or they may be integrated into carrier mailings at a later time, as indicated in path 5-2 of the flowchart of FIG. 2. As indicated in decision block (5B), the saturation mailing in certain instances may be divided into portions, and integrated into the carrier walk sequence (CWS) group over an extended period of time. Note for example, block (8) wherein saturation mailings of half the total number are held for integration and delivery the next day via decision path 5-3.

In the alternative, as illustrated in block (9), the saturation mailings may be treated as additional bundles of mail for distribution by the carrier without collation.

In block (10) of the flowchart of FIG. 2, the vehicle for each carrier is loaded, and departs the DU to deliver the mail to the appropriate addresses in carrier walk sequence (CWS). The entire process may begin again, as indicated in block (11), wherein some of the carriers case mail in the afternoon after delivery to prepare for the deliveries on the next day. Accordingly, it can be seen from the flowchart of FIG. 2, that although the FBC-1 speeds up the collation of flat mail for the respective carriers, there is still a significant amount of other mail processing which occurs at the distribution unit (DU) outside of the FBC-1, which inherently contains certain inefficiencies.

It is a primary object of the present invention, therefore, to eliminate these inefficiencies to the extent possible by expanding the functions of the FBC-1 to include pre-staging of the mail, in addition to the collation thereof in order to expand the use of the FBC-1 system for use with multi-carriers, rather than a single carrier at a time. This is accomplished in accordance with the pre-staging expansion configurations and schemes of FIGS. 3 to 6, to be discussed hereinafter, and the flowchart of FIG. 7.

For some portion of the morning, activities in blocks (2) and (3) of FIG. 2 can overlap with the casing operation (6) and may extend until after the carrier has left the facility, leaving mail to be cased either later that day (11) or the next morning. All cased mail is removed in carrier walk sequence and placed in trays/tubs. Most carriers prefer to place the flats vertically for ease of handling during delivery. Depending on the route type and/or the carrier's preference for marriage mailings, they may case the address card or both the address card and the mailing (some prefer to case only the card and pull the mailing at each house that has a card in the delivery).

These activities can take up to 50% of a carrier's in-office time and therefore limit the amount of deliveries that a carrier can perform in the remainder of the day. Additionally, this can add further collation time in the vehicle throughout the delivery route. This is one of the limiting factors in the number of stops that a carrier route can contain. Obviously the amount of mail, the distance between stops, the demographics of the route area and other factors are involved as well. It stands to reason, that by making the in-office activities more efficient, i.e. providing Delivery Point Sequenced (DPS) flats, carriers can be expected to spend less time in the facility and more time on the route. This added time can allow for additional stops on routes, the possible consolidation of some routes into others, or the capability to provide additional services such as multiple daily scheduled stops at businesses. This scenario is analogous to the introduction of DPS letter mail through the use of DBCS and CSBCS automation to a great degree. The physical nature of flats mail and the different ways that the mail arrives at a facility does make the task of creating a single bundle of DPS flats a challenging proposition.

Figure 3:
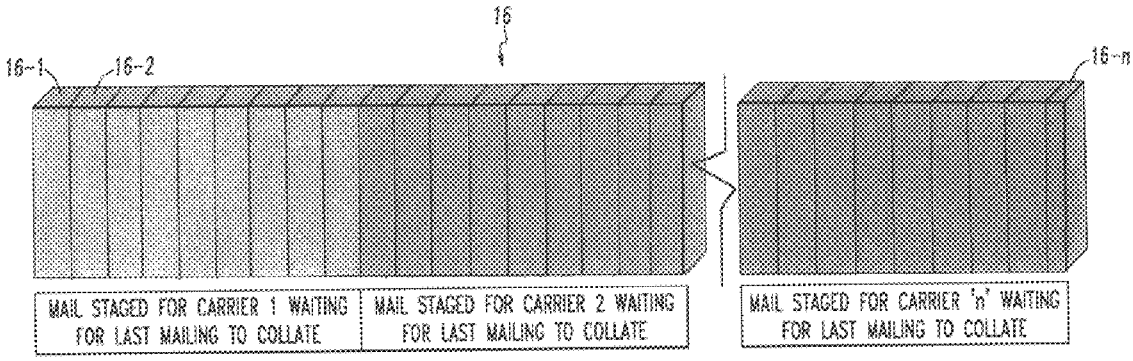
FIG. 3 is a diagrammatic illustration in color of the pre-staging of mail items in carrier-specific subsets in carrier-specific towers of the FBC system of FIG. 1 in a horizontally expanded configuration.
Figure 4:
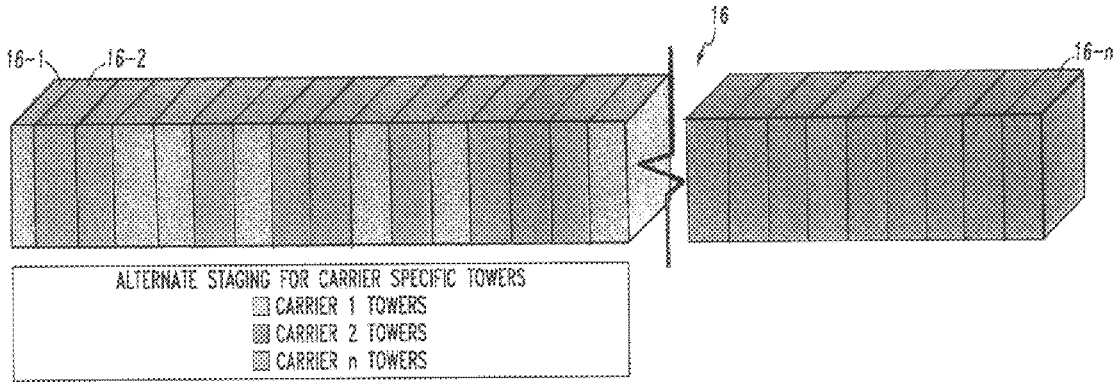
FIG. 4 is a diagrammatic illustration in color of alternate staging of mail items in carrier-specific towers of the FBC system of FIG. 1 as another embodiment of a horizontally expanded configuration.
Figure 5:
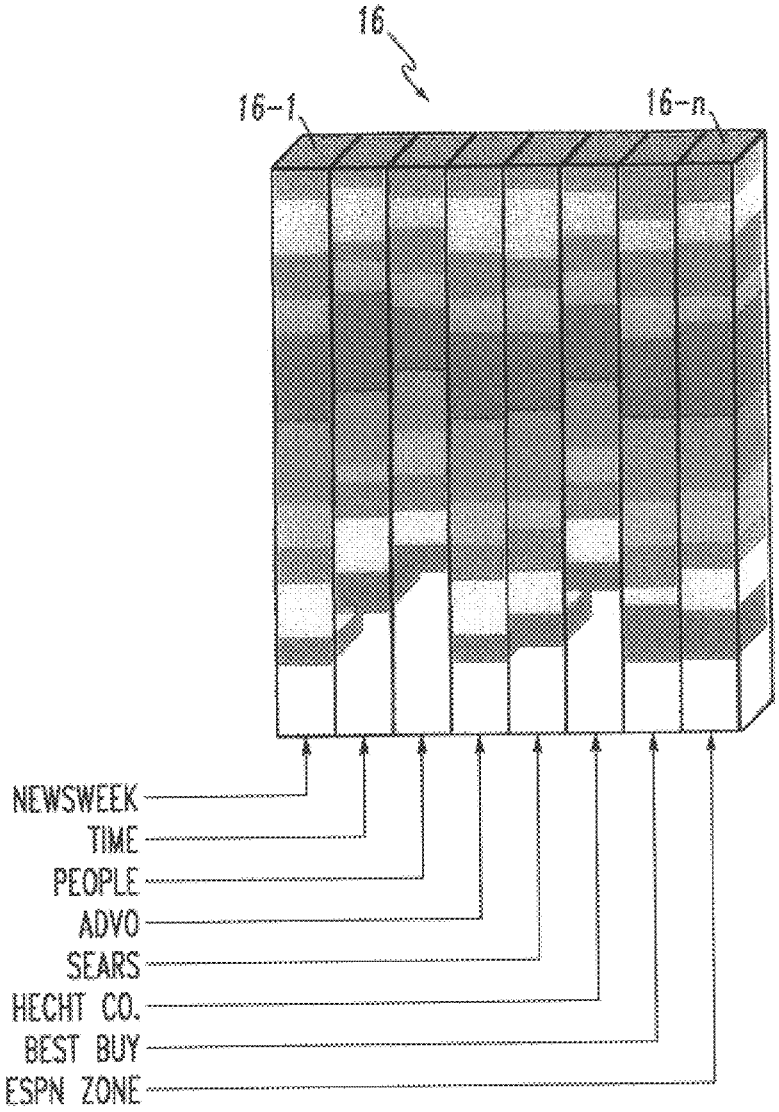
FIG. 5 is a diagrammatic illustration in color of the staging of mail items in content-specific towers with vertically stacked carrier-specific subsets in each respective tower.
Figure 6:
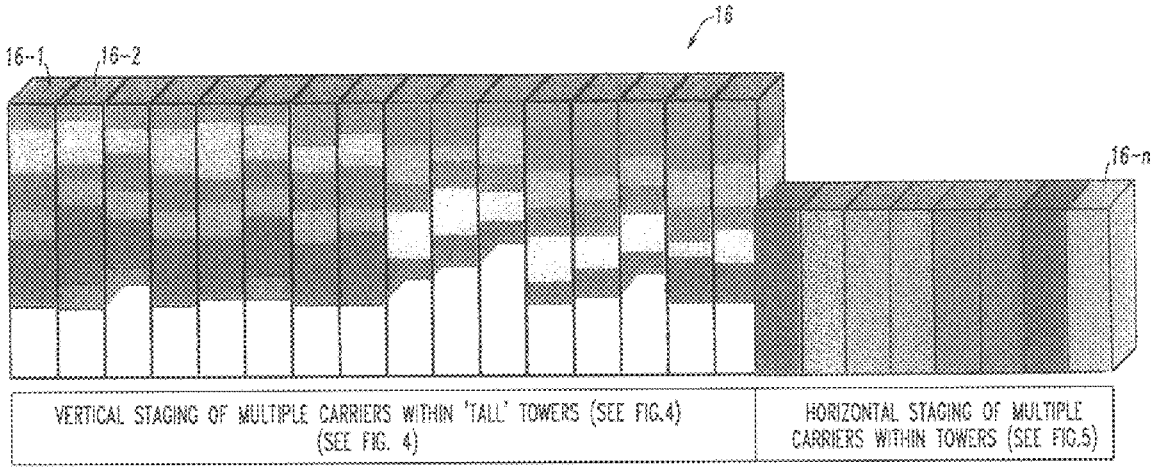
FIG. 6 is a diagrammatic illustration in color combining the vertical staging configuration of FIG. 5 with the horizontal staging of FIG. 4.

The modular approach to staging flats allows the FBC-1 system of FIG. 1 to be expanded either horizontally (more towers) FIGS. 3 and 4, or vertically FIG. 5 (more staging in each tower) or combinations of both in FIG. 6. One aspect of these system concepts is that mail can be staged in the FBC continuously as it arrives in the facility prior to carrier arrival and dispatching. The timeframe for this can be either early morning hours (i.e. 4 AM to 7 AM) or continuous operation (24 hr) or any variation in between. By segregating the mailings within the system by carrier, the system can be utilized as the facility staging area for flats and mail can be collated on a carrier-by-carrier basis as the carriers prepare to leave the facility. In FIGS. 3 to 6 each carrier subset is indicated by a designated identifying color for purposes of explanation.

FIGS. 3 and 4 depict horizontal, multi-carrier FBC concepts of the present invention. As the figures show, carrier flats are pre-staged in carrier-specific towers 16-1, . . . , 16-n, i.e. once mail for carrier x enters a tower, that tower is reserved for carrier x only. Carrier specific towers of FIG. 3 do not necessarily need to be side-by-side; the carrier-specific towers may alternate, as shown in FIG. 4. The pre-staging operation takes place as the mail arrives and collation is performed shortly prior to each carrier leaving the facility. One carrier is collated at a time. When desirable, collation and staging operations can overlap to accommodate unique scheduling requirements. For example, mail for carrier 1 can be collated, then a mailing for carrier 7 staged and then mail for carrier 2 collated and so on. The extension of staging time will allow the facility to send flats directly to the FBC system rather than pre-staging the mail for carriers on the facility floor, in carts, or large casing shelves. By moving the staging process upstream in time, the collation process becomes more efficient when the demand is there. The system configuration of FIG. 3 can also be used to process single carriers in sequence (in the same manner as the baseline FBC-1 system of FIG. 1).

In order to collate an incoming bundle of mail from feeder 10, immediately without pre-staging, all of the towers 16-1, . . . 16-n are available for use in collation, even if a tower has a pre-staged subset of mail stored therein. This is possible because each tower 16-i, for collation purposes, is loaded from the bottom of the tower adjacent to the transport conveyor TC. Thus, sorting or collation can proceed in the same fashion described in the FBC system of FIG. 1, and the aforementioned parent application, Ser. No. 09/310,221, now U.S. Pat. No. 6,241,099, using partially filled towers.

Of course collation can occur in groups of towers 16-i, 16-j, . . . , 16-m saved for collation only, as opposed to those also used for pre-staging. But this would require more towers, and thus a larger tower footprint.

Collation from pre-staged subsets in carrier-specific towers 16-1, . . . , 16-n of FIGS. 3 and 4 can proceed, as if that given tower stands in place of feeder 10. Stated another way, the carrier-specific tower with a pre-staged subset is a virtual input feeder 10. Collation from such a pre-staged tower merely requires an operator command, and sorting and extraction software of the FIG. 1 system modified to treat towers 16-1, . . . , 16-n with pre-staged subsets of mail items as virtual system inputs, so that these subsets are collated in a similar fashion to items passing to towers 16 via feeder 10 without pre-staging.

FIG. 5 depicts a vertical, multi-carrier FBC concept. As the figure shows, carrier flats are pre-staged in carrier-specific subsets within content-specific towers 16-1, . . . , 16-n. For example, each tower has the same magazines therein grouped in carrier-specific vertical segments. This example shows pre-staging for palletized mailings (5 digit). The use of vertical space provides an efficient use of floor-space and provides operational benefits similar to the previous system example. The different colors represent different carriers as in FIGS. 3 and 4.

FIG. 6 depicts a mixed system of vertical, multi-carrier and horizontal carrier specific FBC staging towers 16-1, . . . , 16-n. In this configuration, palletized mailings can be fed into the vertical towers as described in FIG. 5 and the remaining carrier-specific towers are loaded as described in FIG. 4. This system configuration can also be used to process single carriers in sequence, in the same manner as the baseline FBC system (FBC-1) of FIG. 1, using the carrier specific towers in the same way as a vertical feeder 10.

Figure 7:
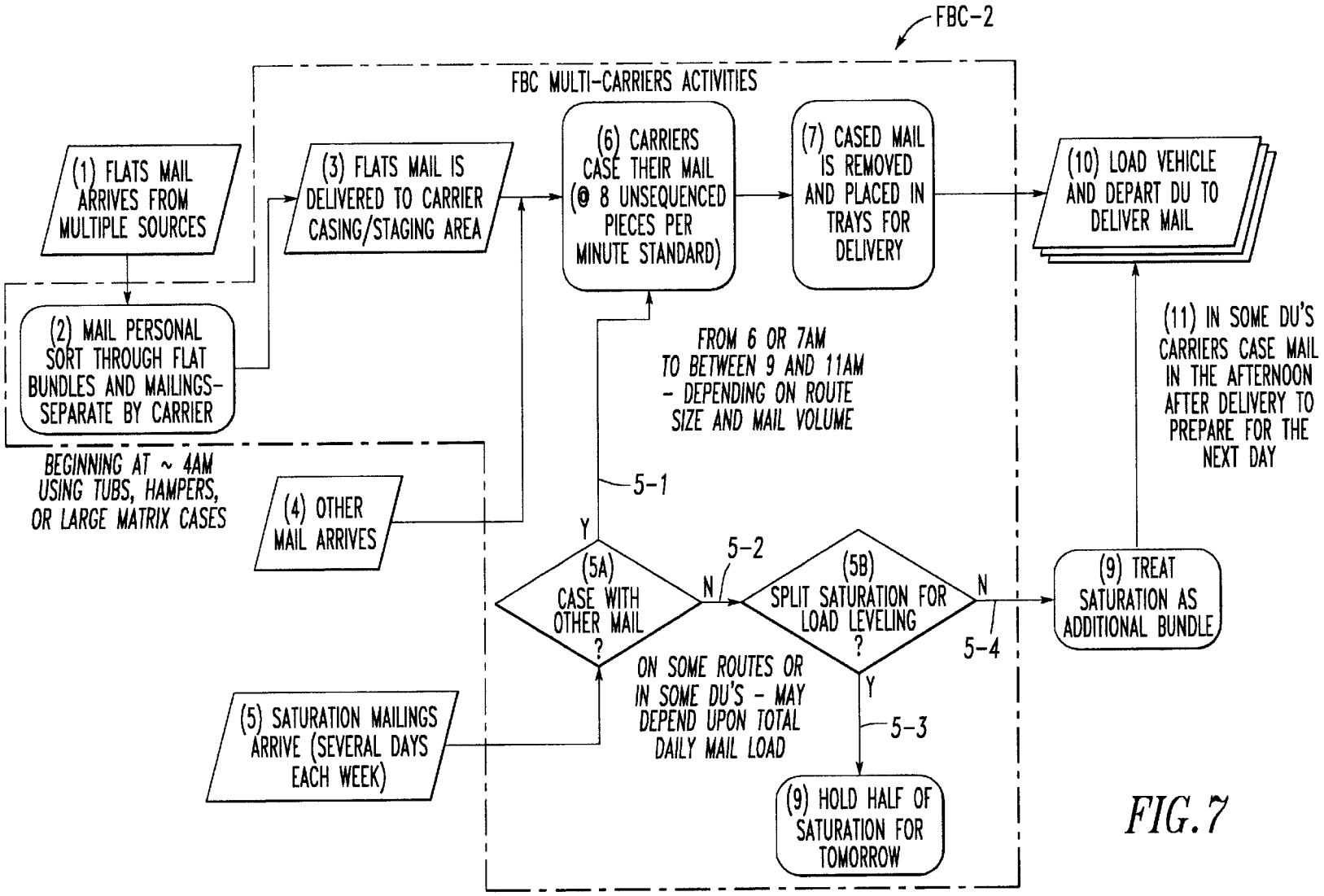
FIG. 7 is a flowchart, similar to that of FIG. 2, illustrating how the functions of the FBC system of FIG. 1 are expanded in accordance with the concepts of the present invention.

FIG. 7, as compared to FIG. 2, is a flowchart depicting how the FBC-1 system of FIG. 2 is expanded to include staging functions, which permit multi-carrier activities. As illustrated in FIG. 7, the FBC multi-carrier activities are enclosed within a dotted line block (FBC-2) to show how the functions of the FBC-1 are expanded to include not only the functions of blocks (6) and (7) described hereinbefore with reference to FIG. 2, but also the functions of blocks (2), (3) and (8), and the decision blocks (5A) and (5B) associated with the processing of saturation mailings. Accordingly, FIG. 7 graphically illustrates how the present invention expands the functions of FBC-1 of FIG. 2 into the additional functions illustrated in FIG. 7. Therefore, the FBC-2 system of FIG. 7, in accordance with the present invention, provides increased efficiencies with respect to the staging and collating of flat mail or multi-carrier activities.

Figure 8:
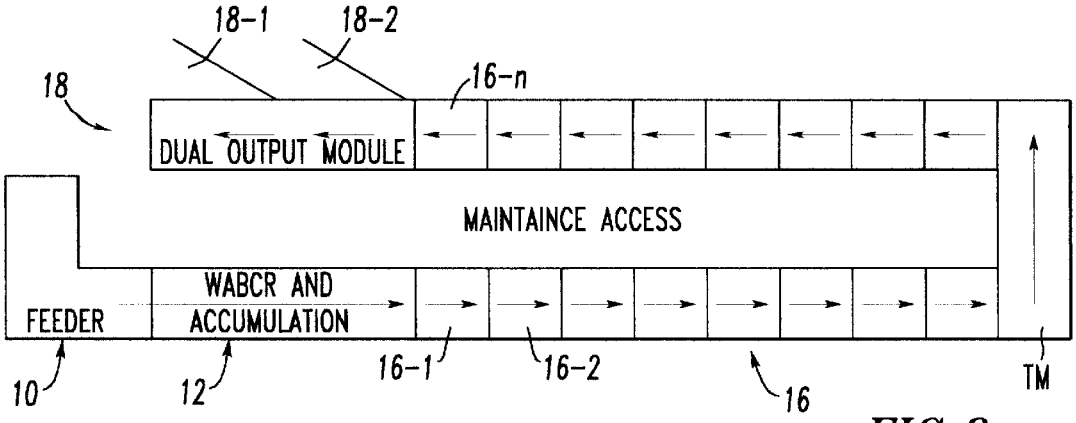
FIG. 8 is a schematic block diagram depicting a U-shaped configuration of the FBC system of FIG. 1.

In addition to the multi-carrier processing, the FBC-1 and FBC-2 system designs provide the capability to configure the system in a variety of layouts to accommodate facility floor space availability and improved operator utilization. FIG. 8 shows a U-shaped FBC configuration including a transition module (TM) that brings the output module 18 near the feeder 10, allowing the operator to monitor the output system and feeder simultaneously. This type of layout, and others, can be applied to all of the previously discussed configurations and operations.

Figure 9:
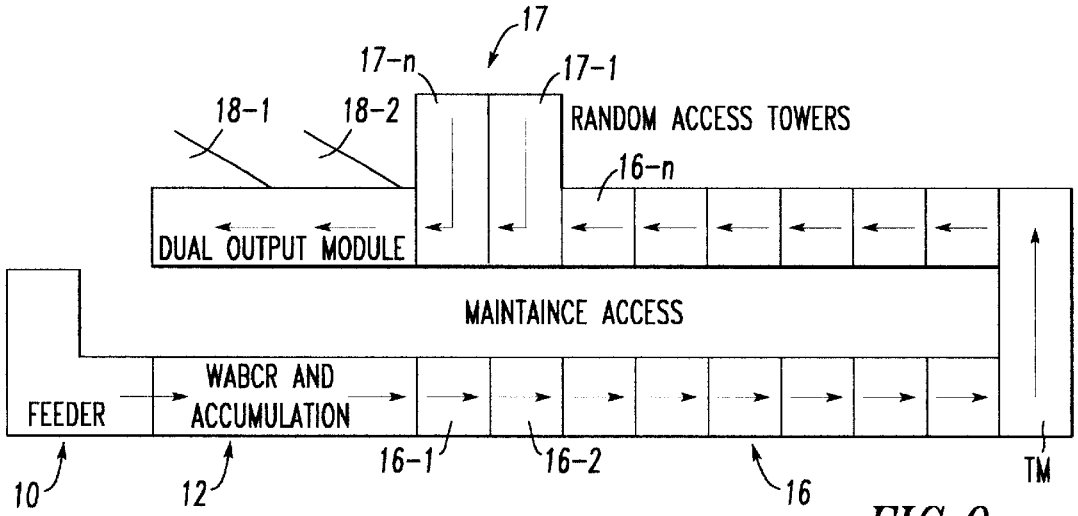
FIG. 9 is a block diagram depicting the U-shaped configuration of FIG. 8 with the addition of random access towers.

"Random Access" towers 17-1, . . . , 17-n can be added to any FBC configuration to provide limited sequencing capabilities, as depicted in FIG. 9. These towers 17-1, . . . , 17-n provide sequencing and staging into the mail conveying path, and allow the system to collate non-sequenced flats along with sequenced flats during output. FIG. 9 shows the same system depicted in FIG. 8 with the last two last-in-first-out (LIFO) of tower assembly 16 replaced with random access towers 17-1, 17-n. This type of tower usage can be also used in any of the previously discussed system configurations.

Figure 10:
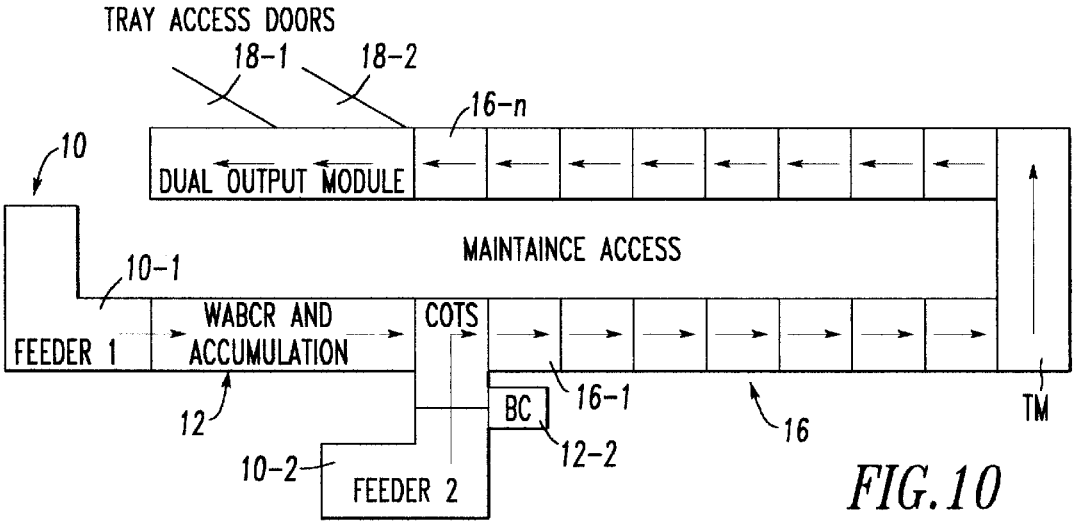
FIG. 10 is a block diagram depicting the U-shaped configuration of FIG. 8 with the addition of a second feeder station.

Other possibilities include a multi-feeder configuration 10-1, 10-2 capable of pre-collation of saturation mailing and mixed DPS mailings prior to collating the resultant mail stream with the contents of the staging towers 16. FIG. 10 shows such a dual feeder FBC system in a U-shape configuration. Flats from Feeder 10-1 are read by a WABCR (for optional OCR reading) 12 and flats from Feeder 10-2 are reader by a COTS laser bar code (BC) reader or any combination of reading devices. This front end, or variations of it, can be added to any of the previously discussed FBC systems. This system would require two system operators during dual-feed mode and feeder placement/merge methods can be varied to optimize operator utilization and floor space requirements.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of collating a plurality of mail items into a final sequenced set of mail items for delivery to predetermined delivery points of a plurality of carrier routes, comprising the steps of:

a) feeding the mail items from a single input stream to a staging station;

b) sampling each mail item in the input stream to determine a carrier route identity, and a delivery point thereof;

c) pre-staging selected ones of the mail items at the staging station into a plurality of subsets of mail items, said staging station having a plurality of storage units $X_1$ to $X_n$, wherein n is the total number of storage units, said storage units temporarily storing the mail items in carrier-specific subsets by inserting each mail item into a carrier-specific subset in a selected one of the storage units;

d) selectively sorting the mail items of either pre-staged carrier-specific subsets or mail items of a carrier route being fed from the single input stream at the staging station into one or more of subsets of mail items re-sequenced into an intermediate order, as an intermediate step to achieving said final sequenced set, said storage units temporarily storing said items in said subsets by;

1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items; and 2) selectively extracting the mail items from any selected one of the storage units $X_1$ to $X_n$ according to said extraction plan; and e) merging the extracted mail items into a single output stream from the respective subsets of mail items into said final sequenced set in delivery point sequence (DPS).

2. The method of claim 1 comprising the further step of:

collecting portions of the output stream of the mail items in delivery point sequence and reversing the order thereof into batches of mail items in carrier walk sequence (CWS).

3. The method of claim 2 wherein only one subset of items for each carrier route is inserted into, and stored in, some storage units.

4. The method of claim 3 wherein more than one subset of items for a plurality of carrier routes is stored in other storage units.

5. The method of claim 2 wherein more than one subset of items for a plurality of carrier routes is stored in some storage units.

6. The method of claim 2 wherein some of said mail items are in a different order from DPS, and are pre-staged separately in the staging station from the mail items in DPS.

7. The method of claim 6 wherein said different order is random order.

8. The method of claim 6 wherein said different order is enhanced carrier line-of-travel (LOT).

9. A computer program embodied in a machine-readable medium for collating a plurality of mail items into a final sequenced set of mail items for delivery to predetermined delivery points of a plurality of carrier routes, comprising the steps of:

a) a segment for feeding the mail items from a single input stream to a staging station;

b) a segment for sampling each mail items in the input stream to determine a carrier route identity, and a delivery point thereof;

c) a segment for pre-staging selected ones of the mail items at the staging station into a plurality of subsets of mail items, said staging station having a plurality of storage units $X_1$ and $X_n$, wherein n is the total number of storage units, said storage units temporarily storing the mail items in carrier-specific subsets by inserting each mail item into a carrier-specific subset in a selected one of the storage units;

d) a segment for selectively sorting the mail items of either pre-staged carrier-specific subsets or mail items of a carrier route being fed from the single input stream at the staging station into one or more of subsets of mail items re-sequenced into an intermediate order, as an intermediate step to achieving said final sequenced set, said storage units temporarily storing the mail items in said subsets by instruction from the program for;

1) inserting each of the mail items into any selected one of said storage units $X_1$ to $X_n$ in accordance with an insertion plan consistent with an extraction plan for the mail items from those storage units for achieving the delivery point sequence (DPS) of the final sequenced set of mail items; and 2) selectively extracting the mail items from any selected one of the storage units $X_1$ to $X_n$ according to said extraction plan; and e) a segment for merging the extracted mail items into a single output stream from the respective subsets of mail items into said final sequenced set in delivery point sequence (DPS).

10. The computer program of claim 9 comprising a further segment for:

collecting portions of the output stream of the mail items in delivery point sequence and reversing the order thereof into batches of mail items in carrier walk sequence (CWS).

11. The computer program of claim 10 wherein only one subset of items for each carrier route is inserted into, and stored in, some storage units.

12. The computer program of claim 11 wherein more than one subset of items for a plurality of carrier routes is stored in other storage units.

13. The computer program of claim 10 wherein more than one subset of items for a plurality of carrier routes is stored in some storage units.

14. The computer program of claim 10 wherein some of said mail items are in a different order from DPS, and are pre-staged separately in the staging station from the mail items in DPS.

15. The computer program of claim 14 wherein said different order is random order.

16. The computer program of claim 14 wherein said different order is enhanced carrier line-of-travel (LOT).

17. A computer program embodied in a digital signal for collating a plurality of mail items into a final sequenced set of mail items for delivery to predetermined delivery points of a plurality of carrier routes, comprising the steps of:

a) a segment for feeding the mail items from a single input stream to a staging station;

b) a segment for sampling each mail items in the input stream to determine a carrier route identity, and a delivery point thereof;

c) a segment for pre-staging selected ones of the mail items at the staging station into a plurality of subsets of mail items, said staging station having a plurality of storage units $X_1$ to $X_n$, wherein n is the total number of storage units, said storage units temporarily storing the mail items in carrier-specific subsets by inserting each mail item into a carrier-specific subset in a selected one of the storage units;

d) a segment for selectively sorting the mail items of either pre-staged carrier-specific subsets or mail items of a carrier route being fed from the single input stream at the staging station into one or more of subsets of mail items re-sequenced into an intermediate order, as an intermediate step to achieving said final sequenced set, said storage units temporarily storing said items in said subsets by instruction from the program for:

1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items; and 2) selectively extracting the mail items from any selected one of the storage units $X_1$ to $X_n$ according to said extraction plan; and e) a segment for merging, the extracted mail items into a single output stream from the respective subsets of mail items into said final sequenced set in delivery point sequence (DPS).

18. The computer program of claim 17 comprising a further segment for:

collecting portions of the output stream of the mail items in delivery point sequence and reversing the order thereof into batches of mail items in carrier walk sequence (CWS).

19. The computer program of claim 18 wherein only one subset of items for each carrier route is inserted into, and stored in, some storage units.

20. The computer program of claim 19 wherein more than one subset of items for a plurality of carrier routes is stored in other storage units.

21. The computer program of claim 18 wherein more than one subset of items for a plurality of carrier routes is stored in some storage units.

22. The computer program of claim 18 wherein some of said mail items are in a different order from DPS, and are pre-staged separately in the staging station from the mail items in DPS.

23. The computer program of claim 22 wherein said different order is random order.

24. The computer program of claim 22 wherein said different order is enhanced carrier line-of-travel (LOT).

25. A system for collating a plurality of mail items into a final sequenced set of mail items for delivery to predetermined delivery points of a plurality of carrier routes, comprising the steps of:

a) means for feeding the mail items from a single input stream to a staging station;

b) means for sampling each mail item in the input stream to determine a carrier route identity, and a delivery point thereof;

c) means for pre-staging selected ones of the mail items at the staging station into a plurality of subsets of mail items, said staging station having a plurality of storage units $X_1$ to $X_n$ wherein n is the total number of storage units, said storage units temporarily storing the mail items in carrier-specific subsets by inserting each mail item into a carrier-specific subset in a selected one of the storage units;

d) means for selectively sorting the mail items of either pre-staged carrier-specific subsets or mail items of a carrier route being fed from the single input stream at the staging station into one or more of subsets of mail items re-sequenced into an intermediate order, as an intermediate step to achieving said final sequenced set, said storage units, temporarily storing said items in said subsets by;

1) inserting each mail item into any selected one of said storage units $X_1$ to $X_n$ in accordance with an insertion plan consistent with an extraction plan for the mail items from those storage units for achieving the delivery point sequence (DPS) of the final sequenced set of mail items; and 2) selectively extracting the mail items from any selected one of the storage units $X_1$ to $X_n$ according to said extraction plan; and e) means for merging the extracted mail items into a single output stream from the respective subsets of mail items into said final sequenced set in delivery point sequence (DPS).

26. The system of claim 25 further comprising:

means for collecting portions of the output stream of the mail items in delivery point sequence and reversing the order thereof into batches of mail items in carrier walk sequence (CWS).

27. The system of claim 26 wherein only one subset of items for each carrier route is inserted into, and stored in, some storage units.

28. The system of claim 27 wherein more than one subset of items for a plurality of carrier routes is stored in other storage units.

29. The system of claim 26 wherein more than one subset of items for a plurality of carrier routes is stored in some storage units.

30. The system of claim 26 wherein some of said mail items are in a different order from DPS, and are pre-staged separately in the staging station from the mail items in DPS.

31. The system of claim 30 wherein said different order is random order.

32. The system of claim 30 wherein said different order is enhanced carrier line-of-travel (LOT).

33. The system of claim 26 wherein said storage units are arranged to define a U-shaped footprint with an input thereto and an output therefrom adjacently disposed to facilitate loading and unloading of mail items by a single operator.

34. The system of claim 26 wherein said means for feeding includes more than one feeder assembly for inputting different groups of mail items to the staging station.

35. The system of claim 34 wherein at least one of the feeder assemblies includes one of said towers.

* * * * *